United States Patent [19]

Hara

[11] 4,322,705

[45] Mar. 30, 1982

[54] THERMAL CUTOUT FUSE

[75] Inventor: Kunio Hara, Kawasaki, Japan

[73] Assignee: Nifco Inc., Kanagawa, Japan

[21] Appl. No.: 189,264

[22] Filed: Sep. 22, 1980

[30] Foreign Application Priority Data

Sep. 26, 1979 [JP] Japan ..... 54-122536

[51] Int. Cl.[3] ..... H01H 37/76

[52] U.S. Cl. ..... 337/407; 337/409

[58] Field of Search ..... 337/407, 409

[56] References Cited

U.S. PATENT DOCUMENTS 3,781,737 12/1973 Henry ..... 337/407

*Primary Examiner*—Harold Broome

*Attorney, Agent, or Firm*—Thomas W. Buckman; Glenn W. Bowen

[57] ABSTRACT

A thermal cutout fuse comprises a fuse housing, a first lead wire penetrated into the housing interior, a movable contact capable of being turned aslant in the radial direction and energized constantly in the horizontal direction, the movable contact connected to the leading end of the first lead wire, a stationary contact disposed so as to encircle the movable contact, a second lead wire connected to the stationary contact, a solid thermally sensitive pellet capable of melting at a prescribed unsafe temperature, the thermally sensitive pellet disposed inside the housing opposite the movable contact, and a stopper adapted to turn the movable contact aslant and keep it in contact with the stationary contact, the stopper interposed between the thermally sensitive pellet and the movable contact. When the ambient temperature of the fuse reaches the prescribed unsafe level and the thermally sensitive pellet melts, the stopper is deprived of its force tending to press down the movable contact and the movable contact is consequently is sprung up into its horizontal position. Thus, the movable contact is instantaneously separated from the stationary contact.

7 Claims, 9 Drawing Figures

THERMAL CUTOUT FUSE

BACKGROUND OF THE INVENTION

This invention relates to a thermal cutout fuse or thermal switch which cuts off the electric continuity between a pair of lead wires when the temperature thereof reaches a prescribed unsafe level.

Generally, among the thermal cutout fuses of the class using a thermally sensitive pellet which have been suggested to date, those which exhibit good thermal sensitivity characteristics, provide a reliable action to cut off the electric circuit and rely on combined use of a thermally sensitive pellet and a mechanical spring have been preponderant in number.

They are operated by a general principle that the electric continuity is established and retained by having a stationary contact and a movable contact disposed in an intimately joined state within a fuse housing, keeping the movable contact energized constantly in the direction of departing from the stationary contact by means of a mechanical spring and, at the same time, preventing directly or indirectly the movable contact from moving away from the stationary contact by means of a thermally sensitive pellet which is solid and assumes a fixed volume at temperatures below the prescribed unsafe level. In the normal condition, therefore, the two contacts are held in intimate contact with each other and the pair of lead wires terminating into the contacts are allowed to retain electric continuity therebetween. When the temperature of the immediate ambience rises beyond the prescribed unsafe level, the thermally sensitive pellet instantaneously melts and liquefies and, consequently, yields to the energizing force of the mechanical spring, with the result that the movable contact is slid away from the stationary contact and the electric continuity between the two lead wires is cut off.

In the thermal cutout fuse formerly proposed by the inventor (Japanese Published Unexamined patent application No. 42640/1979), the movable contact is slid inside the housing in the direction perpendicular to the plane of contact between the movable contact and the stationary contact. At that time, the peripheral surface of the movable contact is rubbed against the inner wall surface of the housing. When the frictional force generated between the two surfaces varies, even if very slightly, from one fuse housing to another, there may be times when the movable contact will be obstructed from generating a sliding motion or it will be caused to slide in a slanted posture, with the result that the departure of the movable contact from the stationary contact will become incomplete. To ensure that the movable contact produces a smooth sliding motion in case of an emergency, it becomes necessary to use a relatively larger mechanical spring capable of generating a higher energizing force than would otherwise be normally required or to provide the main mechanical spring with an auxiliary spring adapted to prevent the main spring from assuming a slanted posture during its sliding motion. These measures tend to complicate the construction of the fuse, add to the size of the fuse and raise the cost of the fuse.

SUMMARY OF THE INVENTION

An object of this invention is to provide a thermal cutout fuse wherein one part of the movable contact remains in contact with one part of the stationary contact without fail under the normal condition and the two contacts never fail to be separated when the thermally sensitive pellet melts.

To accomplish the object described above according to the present invention, there is provided a thermal cutout fuse which comprises a housing, a first lead wire penetrated into the housing, a movable contact connected to the penetrated end of the first lead wire and adapted to be turned aslant relative to the radial direction thereof and constantly energized in the horizontal direction, a stationary contact adapted to encircle the periphery of the aforementioned movable contact, a second lead wire connected to the stationary contact, a solid thermally sensitive pellet capable of melting at a prescribed unsafe temperature disposed opposite the movable contact within the housing, and a stopper interposed between the aforementioned thermally sensitive pellet and the aforementioned movable contact so as to keep the movable contact turned aslant and held in constant contact with the stationary contact.

When the temperature of the immediate ambience of the fuse rises and reaches the prescribed unsafe level and the thermally sensitive pellet consequently melts, the repulsive force exerted by the pellet upon the stopper and the pressure exerted by the stopper upon the movable contact both cease to exist and, as a result, the movable contact is sprung up into a horizontal position by the force of the coil spring. Thus, the instantaneous separation of the movable contact from the stationary contact is accomplished.

Since the motion of the movable contact during its departure from the stationary contact which results from the melting of the thermally sensitive pellet gives rise to no unwanted frictional force, the thermal cutout fuse of this invention never fails to cut off the flow of electric current effectively.

The other objects and characteristics of the present invention will become apparent from the further disclosure of the invention to be made herein below with reference to the accompanying drawing.

DESCRIPTION OF THE PREFERRED EMBODIMENT

Figure 1:
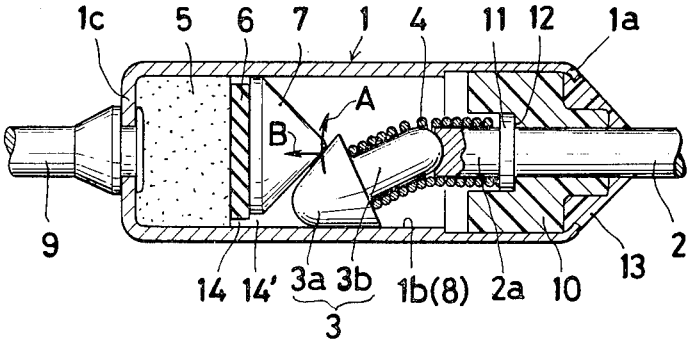
FIG. 1 is a sectioned view of the first embodiment of the thermal cutout fuse according to this invention, in a state of electric continuity.

FIG. 1 is a longitudinal cross-section of the internal construction of the first embodiment of the thermal cutout fuse, held under the normal state at temperatures below the prescribed unsafe level. The fuse has a housing 1 which, in this case, is cylindrical and open at one end 1*a*. Through this open end 1*a*, one end 2*a* of the first lead wire 2 penetrates into the housing. The other end of the lead wire, though not illustrated, extends out of the housing 1.

To the leading end 2*a* of the portion of the first lead wire 2 thrust into the housing, an electroconductive movable contact made of metallic material is connected. In the illustrated embodiment, the movable contact 3 comprises an approximately conical head portion 3*a* possessing a slightly rounded tip and a shank portion 3*b* extending vertically from the bottom of the head portion 3*a* and having a diameter smaller than the diameter of the bottom of the conical head portion. The movable contact 3, therefore, assumes the general shape of a mushroom.

The shank portion 3*b* of this movable contact 3 remains in contact with the penetrated end 2*a* of the first lead wire. Particularly in the illustrated embodiment, the terminal surface of the shank portion 3*b* has a slightly convex spherical surface and the terminal surface of the penetrated end 2*a* of the lead wire has a slightly concave spherical surface so that they more or less fit into each other. A coil spring 4 made of a metallic material is disposed to encircle the outer surfaces of the shank portion 3*b* and the penetrated end 2*a* of the lead wire throughout the combined length of the two members mentioned above.

This coil spring 4, by nature, possesses a tendency to assume a straightened posture along its own axis when left in its natural state. When the movable contact 3 is turned aslant in its radial direction relative to the lead wire 2 as illustrated in FIG. 1, the coil spring is simultaneously bent and made to exhibit a resilient force (in the direction of the arrow "A") against the force of bending. Consequently, the coil spring 4 gives rise to an energizing force which tends to spring the movable contact up toward the center of the housing.

In this case, since the movable contact 3 and the lead wire 2 keep in contact with each other solely through their complementary spherical terminal surfaces, the coil spring 4 not merely serves as means for energizing the movable contact in the horizontal direction but also functions to keep the lead wire 2 and the movable contact 3 in a state of close union. For this reason, the coil spring 4 has an inside diameter smaller than the diameter of the two members mentioned above, so that the two members will be held in a compressed state inside the coil spring and retained securely in the state of union. Besides the functions described above, this coil spring 4 has another function to serve as a parallel current path and diminish the contact resistance between the lead wire 2 and the movable contact 3.

The reason for the aforementioned complementary spherical shapes of the terminal surfaces of the movable contact 3 and the lead wire 2 is that, even when the movable contact 3 is turned aslant and when the angle of this inclination varies within the tolerance of fabrication, the two members are always allowed to keep a fixed contact surface area lest the contact resistance should otherwise increase.

Figure 2:
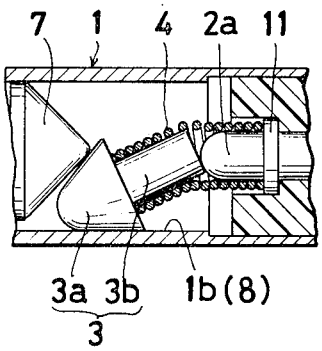
FIG. 2 is a sectioned view of a modification of the contact surfaces of the lead wire and the movable contact of the thermal cutout fuse of FIG. 1.

This is purely a matter for design consideration. Optionally, the movable contact 3 and the lead wire 2 may possess convex spherical surface and concave spherical surface to maintain a surface contact of greater depth as in the known universal globular joint. Conversely where the contact resistance offers no serious problem, there is no particular need for providing the movable contact 3 and the lead wire 2 with such spherical surfaces. Instead, the lead wire 2 alone may be provided with a convex spherical surface at its leading end and the movable contact with a flat surface at its terminal end respectively as illustrated in FIG. 2. Even in this arrangement, since the two members are energized by the coil spring 4 toward their terminal surfaces, they offer no problem in terms of the electric continuity between the pair of lead wires. Of course, the same effect can be obtained by providing the lead wire 2 with a flat surface at the terminal end and the movable contact 3 with a convex spherical surface at the terminal end respectively.

Within the housing 1 and opposite the movable contact 3, a thermally sensitive pellet 5 capable of rapidly melting at its melting point is disposed in a solid state to occupy a fixed volume. To the surface of the solid thermally sensitive pellet opposed to the movable contact, a thermally and electrically insulating stopper 7 made of a plastic material, for example, and adapted to come into direct contact with the movable contact 3 is attached through the medium of a properly elastic sheet 6 made of silicone rubber or Teflon resin, for example. In this case, the stopper 7 has the shape of a cone whose base falls on the thermally sensitive pellet side, and the stopper 7 has a size such that the distance from the sheet 6 to the crown of the cone is greater than the distance from the sheet 6 to the crown of the movable contact 3.

The stopper 7, therefore, has the peripheral surface of its cone held in contact with and pressed against the peripheral surface of the cone of the head portion 3*a* of the movable contact 3. Consequently, the movable contact 3 is turned aslant and retained in the slanted posture so that one part of the conical peripheral surface opposite the part held in contact with the stopper is pressed against one part of the inner wall 1*b* of the housing 1.

In the present embodiment, since the housing 1 itself is made of a metallic material so as to assume a property of conducting electric current, the inner wall 1*b* of the housing constitutes itself a stationary contact surface 8. The second lead wire 9 to be connected to this contact surface 8 is fastened at one end thereof to the bottom end 1*c* of the housing. Thus, the second lead wire is electrically and mechanically fastened to the housing.

Owing to the arrangement described above, in the normal condition illustrated in FIG. 1, the path of electric current is formed from the first lead wire 2 to the second lead wire 9 successively through the movable contact 3, the inner wall 1*b* (stationary contact surface 8) of the housing and the housing 1.

The thermal cutout fuse of this embodiment is assembled as follows.

First, the second lead wire 9 is connected to the closed end 1*c* of the housing 1 by caulking, soldering or welding, and the thermally sensitive pellet 5 is inserted through the open end 1*a* of the housing 1. Then, the elastic sheet 6 is dropped to position on the pellet 5 and the conical stopper 7 intended for contact with the movable contact 3 is inserted.

On the other hand, the first lead wire 2 is preparatorily penetrated into the insulating bushing 10, the coil spring 4 is inserted around the first lead wire to half the entire length of the coil spring 4 and the shank portion 3*b* of the movable contact 3 is pushed into the remaining portion of the coil spring 4 to complete their combination.

Then, this combination is inserted in the direction of the movable contact 3 into the housing 1. First, the head portion 3*a* of the movable contact 3 which stands erect coaxially with the first lead wire 2 collides with the conical stopper 7. When, in this state, the forced insertion of the lead wire 2 and the bushing 10 into the housing interior, the slightly rounded tip of the head portion 3*a* slips in some radial direction against the crown of the stopper 7 and the lateral surface of the head portion moves along the lateral surface of the stopper 7 and the movable contact as a whole is gradually turned aslant in spite of the force of the coil spring 4. Finally, the movable contact advances in the inclined direction and collides with the inner wall 1*b* of the housing which constitutes the stationary contact surface 8 and assumes the state illustrated in FIG. 1. The various parts of the fuse are given prescribed sizes such that when they are assembled as illustrated, the bushing 10 which carries the lead wire 2 in an insulated state snugly settles close to the open end 1*a* of the housing. To preclude accidental removal of the lead wire 2 from the housing, it suffices to provide a radially expanded portion 11 halfway in the length of the lead wire 2 laid through the bushing 10 and to form, at the corresponding position of the bushing, a stepped surface 12 adapted to come into contact with the radially expanded portion in the axial direction.

Thereafter, the open end 1*a* of the housing is closed as illustrated by caulking, for example, to keep the internal structure intact. Optionally, the open end 1*a* may be provided with a seal 13 of a proper synthetic resin. When necessary, the entire outer surface of the housing 1 may be covered with a coat of synthetic resin.

In the finished condition of the fuse which is obtained as described above, the movable contact 3 is turned aslant and is subject to the energizing force exerted by the coil spring in the direction of the arrow "A", namely, in the horizontal direction. Conversely, this force is conveyed as a repulsive force to the stopper 7 which keeps the movable contact 3 pushed down in such an inclined state, giving rise to a component of force tending to push off the stopper in the axial direction (the direction of the arrow "B") through the medium of the plane of contact between the two members. In other words, the stopper 7 is subject to the force which tends to move the stopper away from the movable contact as described above. While the fuse is in its normal condition, since the thermally sensitive pellet 5 remains fast in its solid state behind the stopper 7 and resists this force and, consequently, keeps the stopper 7 fast in position. As a result, the movable contact 3 is also prevented from producing a motion toward returning to its horizontal position and, hence, is retained in contact with the stationary contact surface 8.

When the ambient temperature of the thermal cutout fuse rises to the level corresponding to the melting point of the thermally sensitive pellet 5 in use, the pellet 5 instantaneously melts as is naturally expected from the well-known nature of this type of pellet.

Consequently, the pellet which in its stationary state assumes a fixed volume and successfully resists the aforementioned axial force "B" exerted upon the stopper 7 is deprived of its repulsive force. As a result, the stopper 7 is also deprived of the force tending to hold the movable contact 3 fast in position and the movable contact 3 is sprung up to its horizontal position under the force of the coil spring 4. Instantaneously, therefore, the movable contact 3 is separated from the inner wall 1*b* of the housing (stationary contact surface 8). Of course, the stopper 7 is pushed away in the axial direction in response to this separation.

Figure 3:
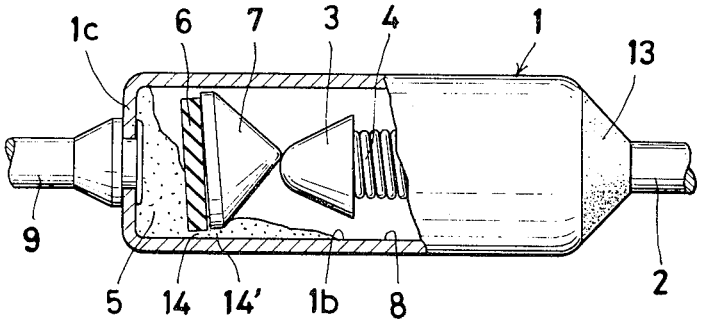
FIG. 3 is a sectioned view of the thermal cutout fuse of FIG. 1, in a state of broken electric continuity.

The thermal cutout fuse then assumes the state of FIG. 3 in which the electric continuity between the two lead wires is broken.

In the thermal cutout fuse of the present invention, the departing motion of the movable contact 3 which ensues from the melting of the thermally sensitive pellet at the prescribed unsafe temperature never produces any unwanted frictional force as described above. There is absolutely no possibility of the departing motion being obstructed as frequently experienced with the conventional fuses. The fuse of this invention can be relied on to provide perfect breakage of the electric continuity in case of an emergency, and it operates effectively with a coli spring 4 of a relatively small power.

In the present embodiment, since the thermally sensitive pellet 5 melts within a closed space, there is a possibility that the pellet, though in its liquefied state, will offer resistance to the movement of the stopper 7. With a view to precluding this possibility, this invention contemplates giving to the elastic sheet 6 on the surface of this pellet a diameter smaller than the inside diameter of the housing 1 thereby giving rise to an annular space 14 around the elastic sheet for aiding in the escape of the molten pellet in the circumferential direction. For the same purpose, the stopper 7 is also given a diameter smaller than the inside diameter of the housing so as to give rise to a gap 14'. Since, in the normal state, the stopper 7 is pressed by the resilient force of the movable contact 3 against the inner wall 1*b* of the housing on the side opposite the position at which the movable contact remains in contact with the stationary contact surface, the aforementioned gap 14' is allowed to occur only in one radial direction. The elastic sheet 6 is incorporated in this fuse to fulfill the role of stably supporting the stopper 7 in position even when the pellet 5 has a coarse surface and discharge the function of preventing the heat generated by the contact resistance between the two contacts 3, 8 from being conducted to the pellet 5 as much as possible. It may be omitted when the pellet 5 has a smooth surface.

Figure 4:
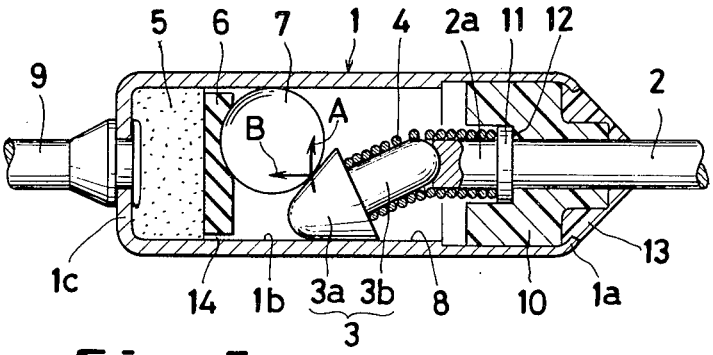
FIG. 4 is a sectioned view of the second embodiment of the thermal cutout fuse of this invention, in a state of electric continuity.
Figure 5:
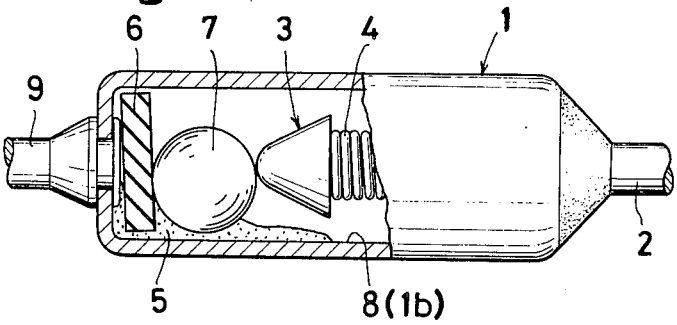
FIG. 5 is a sectioned view of the thermal cutout fuse of FIG. 4, in a state of broken electric continuity.

The second embodiment illustrated in FIG. 4 and FIG. 5 is functionally identical with the embodiment of FIG. 1 in all respects, except that the stopper to be used therein has a spherical shape. Thus, the identical or similar components of this embodiment are denoted by like numerical symbols and the description of the construction is omitted to avoid repetition. This spherical stopper, by nature, is desired to be made of less expensive glass rather than of a plastic material.

One of the merits derived from the substitution of the conical stopper with the spherical one is that, in the course of assembly of the fuse, the insertion of the stopper into the housing interior can be achieved more conveniently. When the stopper 7 has a conical shape as in the preceding embodiment, it must be inserted into the housing with great care so that the bottom surface thereof will land flatly on the surface of the pellet.

When the stopper has a spherical shape which is devoid of directionality, the insertion can be made without any such care.

Further when the movable contact 3 is inserted together with the lead wire 2 and, after collision with the stopper, further pushed in against the energizing force of the coil spring 4 until the movable contact 3 is turned aslant in one radial direction, this spherical stopper permits the movable contact not only to enjoy freedom of slippage thereon but also to avail itself of the rotation of the sphere. Consequently, the movable contact 3 can be turned aslant more smoothly. Moreover, at the time that the thermally sensitive pellet melts and the movable contact 3 resumes its natural posture as illustrated in FIG. 5 after the ambient temperature of the fuse has risen to the prescribed unsafe level, the stopper 7 can be pushed away more rapidly by making effective use of the rotation of this sphere than when the stopper 7 is pushed out by utilizing only the freedom of slippage on the surface of contact. Besides, since the sphere itself makes a point contact with the inner wall of the housing, the frictional resistance exerted by the motion of the movable contact upon the sphere is minimal. This fact also contributes to enhancing the speed of the motion of the movable contact.

In the present embodiment, since the sphere comes into a point contact with the pellet 5 or the sheet 6, there is a possibility that when this point contact lasts for a long time, the portion of the pellet or the sheet kept in contact with the sphere will deform and the force with which the sphere holds the movable contact fast in position will decrease consequently.

Figure 6:
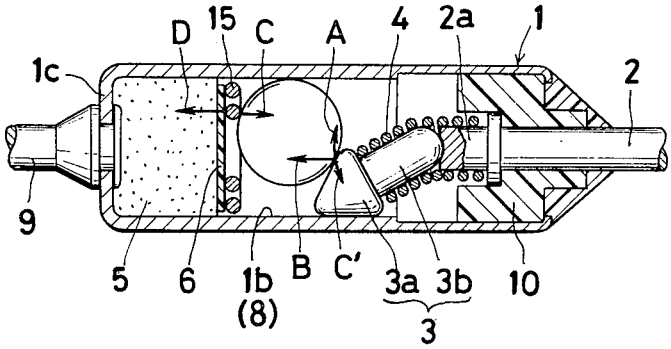
FIG. 6 is a sectioned view of the third embodiment of the thermal cutout fuse of the present invention, in a state of electric continuity.
Figure 7:
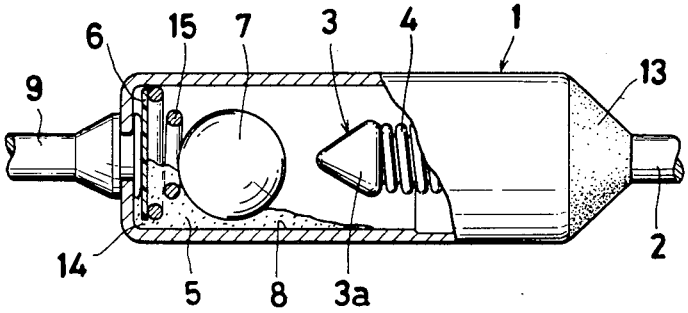
FIG. 7 is a sectioned view of the thermal cutout fuse of FIG. 6, in a state of broken electric continuity.

The third embodiment of the thermal cutout fuse of this invention which is free from the disadvantage mentioned above will be described with reference to FIG. 6 and FIG. 7.

The third embodiment has a second coil spring 15 interposed in a contracted state between the surface of the thermally sensitive pellet 5 (or the sheet 6, if used on the surface of the pellet) and the spherical stopper 7.

By the second coil spring, the spherical stopper 7 is supported stably in position and the force of contact exerted by the spherical stopper upon the sheet 6 or the pellet surface 5 is dispersed throughout the entire length of one turn of the coil in contact with the surface enough to prevent otherwise possible plastic deformation of the surface. Further, the force "C" which the coil spring 15 exerts upon the spherical stopper gives rise to a component force "C'" tending to hold down the movable contact 3 more strongly. Thus, the second coil spring also contributes to all the more ensuring the electric continuity of the fuse in its normal state.

Moreover, the force of the coil spring 15 also produces a component force "D" on the pellet side. When the pellet 5 melts at the prescribed unsafe temperature, therefore, this component force serves to expedite the removal of the molten pellet from behind the spherical stopper and lends itself to heightening the speed of circuit breakage.

The strength of this second coil spring 15 can be freely selected without reference to the strength of the main coil spring 4. Of course, inconvenience is experienced when the stroke of the coil spring from its contracted state to its liberated state is so long that, after the pellet has melted, the sphere thrusts itself into the space in which the movable contact is destined to spring up to its horizontal position.

Where the sheet 6 has no possibility of undergoing any plastic deformation, the sheet given an increased thickness enough to manifest sufficiently high resiliency as in the second embodiment can fulfill to some extent the effect which the second coil spring 15 demonstrates in ensuring the electric continuity and expediting the speed of the circuit breakage. When the stopper is made of a substance such as silicone rubber which abounds with elasticity and possesses high insulating property, no use may be found for the sheet 6 or the spring 15. Of course, in the first embodiment using the conical stopper, the second coil spring 15 can be effectively utilized.

Figure 8:
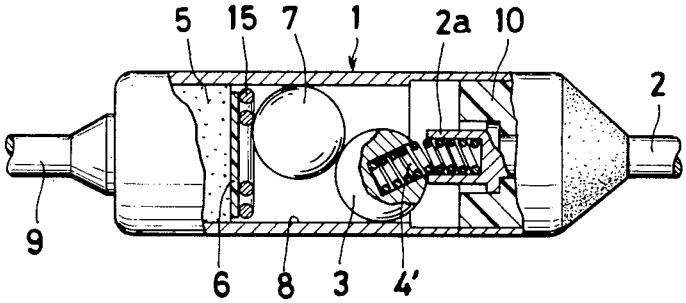
FIG. 8 is a sectioned view of the fourth embodiment of the thermal cutout fuse of this invention, in a state of electric continuity.

The shape of the movable contact 3 is not limited to that of a mushroom. When it is formed in the shape of a sphere as illustrated in FIG. 8, blind holes of a suitable diameter are bored one each in the basal end of the spherical movable contact 3 and in the leading end 2*a* of the lead wire 2 and a coil spring 4' of a diameter slightly larger than the diameter of the holes is inserted on one end into the hole of the spherical movable contact and on the other end into the hole of the lead wire respectively. In the normal state, the spherical movable contact is kept in contact with the stationary contact 8 by the stopper 7. When the ambient temperature of the thermal cutout fuse reaches the prescribed unsafe level, the thermal sensitive pellet 5 immediately begins to melt and the spherical movable contact 3 is pushed up to its horizontal direction by the coil spring 4', with the result that the electric continuity of the two lead wires 2, 9 is broken.

Figure 9:
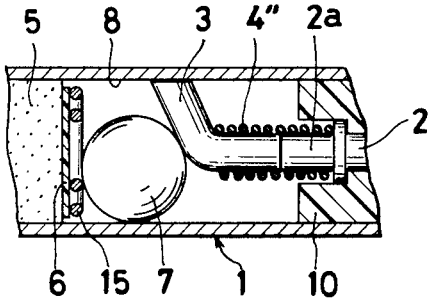
FIG. 9 is a sectioned view of the fifth embodiment of the thermal cutout fuse of this invention, in a state of electric continuity.

FIG. 9 illustrates an embodiment using as the movable contact a bar-shaped contact 3 having the leading end bent. The bar-shaped contact is connected fast to the leading end 2*a* of the lead wire 2 by means of a spring 4'' which is bent in the direction opposite that of the aforementioned bar-shaped contact. In the normal state, the leading end surface of the bar-shaped contact 3 is kept in contact with the stationary contact 8 by the stopper 7 to maintain electric continuity between the two lead wires. When the thermally sensitive pellet 5 melts at the prescribed unsafe level, the stopper 7 is deprived of the force for keeping the movable contact in its bent state. Consequently, the bar-shaped contact is caused to separate from the stationary contact and the electric continuity is broken.

In each of the embodiments so far described, the inner wall 1*b* of the housing constitutes a stationary contact surface 8 disposed around the movable contact 3. Alternatively, the housing 1 may be made of an insulating substance and the stationary contact surface made of an electroconductive substance may be separately disposed inside the housing so as to encircle the movable contact.

As regards the directions in which the pair of lead wires are drawn out of the housing, the lead wires are drawn out in opposite directions in all the embodiments. It will be self-evident, however, that the lead wire 9 may be drawn out of the housing in the same direction as the lead wire 2. For example, an idea of having the one lead wire 9 secured to the illustrated open end 1*a* of the housing may readily occur to anyone. From this idea, one may easily conceive of an idea of separately preparing the stationary contact surface 8, attaching the second lead wire 9 thereto and drawing this lead wire 8 out in the same direction as the first lead wire 2, and incorporating this arrangement into the housing interior.

In any event, the present invention can provide a thermal cutout fuse which ensures rapid and reliable breakage of electric circuit without suffering the circuitbreaking motion of the movable contact to be obstructed by friction.

What is claimed is:

1. A thermal cutout fuse, comprising:

a housing, a first lead wire penetrating into said housing, a movable contact connected to said first lead wire within said housing and adapted to be turned aslant in the radial direction within the housing, resilient means for biasing said movable contact constantly in a first direction, said resilient means being constructed so as to be capable of flexing in a second direction while supporting said movable contact, a stationary contact encircling said movable contact, a second lead wire connected to said stationary contact and extending out of said housing, a thermally-sensitive pellet having first and second states according to the temperature acting on it disposed inside the housing at a location spaced from said movable contact, and an insulating means constructed to control said movable contact in a first manner in which said resilient means is flexed in said second direction when said pellet is in one of said states and in a second manner in which said resilient means is not flexed in said direction when said pellet is in the other of said states so that said movable contact is in contact with said stationary contact when said pellet is in one of said states and is not in contact with said stationary contact when said pellet is in the other said states, said pellet being constructed so the one of said first and second states of said pellet is a solid state and the other of said states is a fluid state.

2. The thermal cutout fuse according to claim 1, wherein said insulating means has the shape of a cone and one part of the peripheral surface of said cone comes into contact with said movable contact.

3. The thermal cutout fuse according to claim 1, wherein said insulating means has the shape of a sphere and one part of the peripheral surface of said sphere comes into contact with said movable contact.

4. The thermal cutout fuse according to claim 1, wherein energizing means is interposed in a constructed state between said thermally sensitive pellet and said insulating means.

5. The thermal cutout fuse according to claim 1, wherein said insulating means is made of silicone rubber.

6. The thermal cutout fuse according to claim 1, wherein said movable contact has the shape of a mushroon having the shank portion connected to said first lead wire with a conical head portion held in contact with said stationary contact.

7. The thermal cutout fuse according to claim 1, wherein said movable contact has the shape of a sphere and one part of the surface of said sphere comes into contact with said stationary contact.

* * * * *